US007215789B2

(12) United States Patent
Shennib et al.

(10) Patent No.: US 7,215,789 B2
(45) Date of Patent: May 8, 2007

(54) DISPOSABLE EXTENDED WEAR CANAL HEARING DEVICE

(75) Inventors: Adnan Shennib, Fremont, CA (US); Richard C. Urso, Redwood City, CA (US)

(73) Assignee: InSound Medical, Inc., Newark, CA (US)

( * ) Notice: Subject to any disclaimer, the term of this patent is extended or adjusted under 35 U.S.C. 154(b) by 0 days.

(21) Appl. No.: 10/052,199

(22) Filed: Jan. 16, 2002

(65) Prior Publication Data

US 2002/0085728 A1 Jul. 4, 2002

Related U.S. Application Data

(63) Continuation of application No. 09/327,717, filed on Jun. 8, 1999, now Pat. No. 6,473,513.

(51) Int. Cl.
*H04R 25/00* (2006.01)

(52) U.S. Cl. ..... 381/328; 381/322; 381/324; 381/323; 381/325; 381/329

(58) Field of Classification Search ..... 381/322, 381/324, 325, 328, 323; 181/130, 135
See application file for complete search history.

(56) References Cited

U.S. PATENT DOCUMENTS 5,572,594 A * 11/1996 Elkins ..... 119/502
5,701,348 A * 12/1997 Shennib ..... 381/328
6,137,889 A * 10/2000 Shennib et al. ..... 381/328
6,229,900 B1 * 5/2001 Leenen ..... 381/314
6,359,993 B2 * 3/2002 Brimhall ..... 381/328
6,473,511 B1 * 10/2002 Aceti ..... 381/322
6,473,513 B1 * 10/2002 Shennib et al. ..... 381/328

* cited by examiner

*Primary Examiner*—Huyen Le
*Assistant Examiner*—Dionne Harvey
(74) *Attorney, Agent, or Firm*—Townsend and Townsend and Crew LLP

(57) ABSTRACT

A disposable hearing device is adapted to be positioned entirely within an ear canal for extended wear therein. The device includes a core assembly and a sealing retainer. The core assembly includes a lateral section of generally oval cross-section and generally elongated cylindrical shape for alignment substantially along the ear canal's longitudinal axis, and a receiver section having a receiver coupled to the lateral section for medial positioning in the ear canal's bony region. The lateral section includes a microphone and a battery assembly, and is dimensioned to avoid occluding the ear canal while it is at least partially laterally suspended therein. The sealing retainer is concentrically positioned over the receiver section, and has a composition to conform to the ear canal's bony region wall to seat the hearing device and acoustically seal it in the ear canal to inhibit feedback therein.

26 Claims, 10 Drawing Sheets

DISPOSABLE EXTENDED WEAR CANAL HEARING DEVICE

CROSS-REFERENCE TO RELATED APPLICATIONS

This application is a continuation of Ser. No. 09/327,717 filed Jun. 8, 1999, now U.S. Pat. No. 6,473,513, issued Oct. 29, 2002, titled "Extended Wear Canal Hearing Device," of the same assignee. This application is also related to co-pending patent application Ser. No. 09/190,764, filed Nov. 12, 1998, titled "Battery Enclosure for Canal Hearing Devices", now U.S. Pat. No. 6,208,741, issued Mar. 27, 2001, and Ser. No. 09/199,699, filed Nov. 25, 1998, titled "Semi-Permanent Canal Hearing Device," referred to herein as "the '741 patent" and "the '699 application," respectively.

BACKGROUND OF THE INVENTION

A. Technical Field

The present invention relates to hearing devices, and, more particularly, to miniature hearing devices that are deeply positioned in the ear canal for improved energy efficiency, sound fidelity, and inconspicuous extended wear.

B. Description of the Prior Art

Brief Description of Ear Canal Anatomy

The external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. Canal dimensions vary significantly among individuals as shown below in the section titled Experiment.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see. e.g., Ballachanda, *The Human ear Canal*, singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous.

The junction between the concha cavity 2 and the cartilaginous part 11 of the ear canal at the aperture 17 is also defined by a characteristic bend 12 known as the first bend of the ear canal.

Several types of hearing losses affect millions of individuals. Hearing loss particularly occurs at higher frequencies (4000 Hz and above) and increasingly spreads to lower frequencies with age.

Limitations of Conventional Canal Hearing Devices

Conventional hearing devices that fit in the ear of individuals generally fall into one of 4 categories as classified by the hearing aid industry: (1) Behind-The-Ear (BTE) type which is worn behind the ear and is attached to an ear mold which fits mostly in the concha; (2) In-The-Ear (ITE) type which fits largely in the auricle and concha cavity areas, extending minimally into the ear canal; (3) In-The-canal (ITC) type which fits largely in the concha cavity and extends into the ear canal (see Valente M., *Strategies for Selecting and Verifying Hearing Aid Fittings*, Thieme Medical Publishing. pp. 255–256, 1994), and; (4) Completely-In-the-Canal (CIC) type which fits completely within the ear canal past the aperture (see Chasin, M. *CIC Handbook*, Singular Publishing ("Chasin"), p. 5, 1997).

The continuous trend for the miniaturization of hearing aids is fueled by the demand for invisible hearing products in order to alleviate the social stigma associating hearing loss with aging and disability. With continued improvements in miniaturization of hearing aid components, the battery has emerged as the largest single component in canal hearing devices (ITC and CIC devices are collectively referred to herein as canal devices or canal hearing devices). The conventional battery, button-cell type, remains predominantly used in virtually all hearing aid devices.

In addition to the cosmetic advantage of canal devices, there are actual acoustic benefits resulting from the deep placement of the device within the ear canal. These benefits include improved high frequency response, less distortion, reduction of feedback and improved telephone use (Chasin, pp. 10–11).

However, even with advances leading to the advent of canal devices, there remains a number of fundamental limitations associated with the underlying design and configurations of conventional canal device technology. These problems include: (a) frequent device handling, (b) oscillatory (acoustic) feedback, (c) custom manufacturing and impression taking, (d) energy inefficiency, (e) space inefficiency related to current battery designs, and (f) occlusion related problems. These limitations are discussed in more detail below.

(a) Frequent device handling: Conventional canal devices require frequent insertion and removal from the ear canal. Manufacturers often recommend daily removal for cleaning and maintenance of the CIC device (see, e.g., *Users's Instructions, SENSO CIC and Mini Canal*, Widex Hearing Aid Co. February 97, pp. 11, 16; and *General Information for Hearing aid Users*, Siemens Hearing Instruments, Inc. March 98, p. 8). Daily removal of conventional CICs is also required for relieving the ear from the pressures of the device occluding the cartilaginous region. Furthermore, CIC hearing aid removal is also required in order to replace the conventional button-cell battery, typically lasting less than 2 weeks. The manual dexterity required to manipulate a canal device or replace a conventional battery, daily, poses a serious challenge to many hearing impaired persons who are elderly. These individuals typically suffer from arthritis, tremors, or other neurologic problems that limit their ability to frequently handle a miniature hearing aid.

(b) Oscillatory feedback occurs when leakage (arrows 32 and 32' in FIG. 3) from sound output 30, typically from a receiver 21 (speaker), occur via a leakage path or a vent 23. The leakage (32') reaches a microphone 22 of a canal hearing device 20 causing sustained oscillation. This oscillatory feedback is manifested by "whistling" or "squealing" and is not only annoying to hearing aid users but also interferes with their communication. Oscillatory feedback is typically alleviated by tightly occluding (sealing) the ear canal. However, due to imperfections in the custom manufacturing process (discussed below) or to the intentional venting incorporated within the hearing device (also discussed below) it is often difficult if not impossible to achieve the desired sealing effect, particularly for the severely impaired who require high levels of amplification. Oscillatory feedback typically occurs at high frequencies due to the presence of increased gain at these frequencies.

(c) Custom manufacturing and impression taking: Conventional canal devices are custom made according to an impression taken from the ear of the individual. A canal device housing 25 (FIG. 3), known as shell, is typically custom fabricated according to an individual impression to accurately assume the shape of the individual ear canal. Customizing a conventional canal device is presumed required in order to minimize leakage gaps, which cause feedback, and also to improve the comfort of wear. Custom manufacturing is an imperfect process, time consuming and results in considerable cost overheads for the manufacturer and ultimately the hearing aid consumer (user). Furthermore, the impression taking process itself is often uncomfortable for the user.

(d) Energy inefficiency of conventional canal device is partially due to the distance or residual volume (6 in FIG. 3) between the receiver (speaker) 21 and the tympanic membrane 18. The further the receiver is from the tympanic membrane, the more air mass there is to vibrate; thus, more energy is required. However, due to concerns related to discomfort and difficulty of insertion, CIC products are typically tapered at their medial end 23 (Chasin, pp. 9–10) and relatively shallow in their placement (FIG. 3) in order to avoid substantial contact of the rigid enclosure with the bony portion of the ear canal.

(e) Space inefficiency related to current battery designs: Conventional canal devices employs a unitary enclosure 25 (shell) to protect the internal components within (battery 26, microphone 22, amplifier 24 and receiver 21 in FIG. 3). The shell 25, or a main housing, is a permanent component of the canal device thus is made durable with substantial thickness of about 0.5 to 0.7 mm. The battery, essentially the largest single component of a canal hearing device, also has its own protective housing typically made of nickel-plated iron. This double enclosure of the battery adds considerable dimensions to the overall size of the device and makes it difficult to negotiate its insertion into contoured ear canals. The shape of the conventional button-cell battery is also problematic in view of the ear canal being oval in cross-section (FIG. 2) and cylindrically elongated along the longitudinal axis. Button-cell batteries are circular in cross-section and have length (L) shorter than the diameter (D) of the cross-section as shown in FIG. 4. For example the standard button-cell batteries, models 5A and 10A employed in virtually all conventional CIC devices), have length (L) of about 2.15 and 3.6 mm, respectively, versus a diameter (D) of about 5.8 mm for both.

(f) Occlusion related problems are several and include:

(i) Discomfort, irritation and even pain may occur due to canal abrasion caused by frequent insertion and removal of a canal device. A removal strand 7 (FIG. 3) is generally provided with canal devices to assist the wearer in the daily removal process. Due to the resultant discomfort and abrasion, canal devices are frequently returned to the manufacture in order to improve the custom fit and comfort (e.g., Chasin, p. 44). "The long term effects of the hearing aid are generally known, and consist of atrophy of the skin and a gradual remodeling of the bony canal. Chronic pressure on the skin lining the ear canal causes a thinning of this layer, possibly with some loss of skin appendages" (Chasin, p. 58).

(ii) Moisture and cerumen produced in the cartilaginous ear canal cause damage to the ear canal and the hearing device when the canal is occluded by the hearing device. "The humidity in the occluded portion of the canal increases rapidly. This is worse during hot and humid weather, following exercise" (Chasin, pp. 57–58). To reduce the damaging effects of canal moisture, it is often recommended to remove a CIC device from the ear canal daily to reduce the damaging effects of moisture in the canal. Occlusion by a canal hearing device also interferes with the natural lateral extrusion of cerumen. Cerumen impaction (the blockage of the ear canal by earwax) may also occur when cerumen, produced in the cartilaginous region, is pushed and accumulated deeper in the bony region of ear canal by the frequent insertion of a CIC hearing device (e.g., Chasin, p. 27, pp. 56–57).

(iii) The occlusion effect is a common acoustic problem caused by the occluding hearing device. It is manifested by the perception of a person's "self-sounds" (talking, chewing, yawning, clothes rustling, etc) being loud and unnatural compared to the same sounds with the open (unoccluded) ear canal. The occlusion effect is primarily due to the low frequency components of self-sounds, as is experienced, for example, by plugging the ears with fingers while talking. The occlusion effect is generally related to sounds resonating within the ear canal when occluded by the hearing device. The occlusion effect is demonstrated in FIG. 3 when "self-sounds" 35, emanating from various anatomical structures around the ear (not shown), reach the ear canal 10. When the ear canal is occluded, a large portion of self-sounds 35 are directed towards the tympanic membrane 18 as shown by arrow 34. The magnitude of "occlusion sounds" 34 can be reduced by incorporating an "occlusion-relief vent" 23 across the canal device 20. The occlusion-relief vent 23 allows a portion of the "occlusion sounds" 35 to leak outside the ear canal as shown by arrow 35'.

The occlusion effect is inversely proportional to the residual volume 6 of air between the occluding hearing device and the tympanic membrane. Therefore, the occlusion effect is considerably alleviated by deeper placement of the device in the ear canal. However, deeper placement of conventional devices with rigid enclosures is often not possible for reasons including discomfort as described above. For many hearing aid users, the occlusion effect is not only annoying, but is often intolerable leading to discontinued use of the canal device.

The above limitations in conventional canal devices are highly interrelated. For example, when a canal device is worn in the ear canal, movements in the cartilaginous region "can lead to slit leaks that lead to feedback, discomfort, the occlusion effect, and 'pushing' of the aid from the ear" (Chasin, pp. 12–14). The relationship between these limitations is often paradoxically adverse. For example, occluding the ear canal tightly is desired on one hand to prevent feedback. However, tight occlusion leads to the occlusion effect described above. Attempting to alleviate the occlusion effect by a vent 23 provides an opportunistic pathway for feedback. For this reason alone, the vent 23 diameter is typically limited in CIC devices to about 0.6–0.8 mm (Chasin, pp. 27–28).

Review of State-of the-Art in Related Hearing Device Technology

Cirillo, E., in U.S. Pat. No. 4,830,139 discloses means for holding a speaker mold (16 in Cirillo's FIG. 1) in the ear canal via a sealant made of flexible gelatinous water-soluble material. The mold is attached to a wire (18) extending to the outside of the ear canal, and therefore, the Cirillo device is presumably for hearing devices that are positioned outside the ear canal. Cirillo's disclosure does not deal with devices that are completely positioned in the ear canal. Furthermore, since the sealant is water-soluble it can also be assumed that the sealant is suitable only for short-term use as it will deteriorate with moisture exposure (e.g., when taking a shower, swimming, etc.).

Sauer et al., in U.S. Pat. No. 5,654,530, disclose an insert associated with an ITE device (Sauer's FIG. 1) or a BTE device (Sauer's FIG. 2). The insert is a "sealing and mounting element" made of "soft elastic material having slotted outer circumference divided into a plurality of fan-like circumferential segments". The sealing element is positioned at the lateral portion of the ear canal as shown in the figures. Sauer's disclosure teaches an insert for ITEs and BTEs and is apparently not concerned with inconspicuous hearing devices that are deeply and completely inserted in the ear canal. The insert is obviously in the cartilaginous area, thus occluding the ear canal in the region of hair, and cerumen and sweat production. Clearly, long term use (without daily removal) will interfere in the natural production of physiologic debris.

Garcia et al., in U.S. Pat. No. 5,742,692 disclose a hearing device (10 in Garcia's FIG. 1) attached to a flexible seal 30 which is fitted in the bony region of the ear canal. The device 10 comprises hearing aid components (i.e., microphone 12, receiver 15 and battery 16, etc., as shown by Garcia) which are contained within a single "unitary" housing 20. The device 10 is not likely to fit deeply and comfortably in many small and contoured canals due to the space inefficiency associated with the unitary housing 20. In addition to the size disadvantage, the device 10 occludes the ear canal in the cartilaginous region as shown in Garcia's FIG. 2.

Henneberger and Biermans in U.S. Pat. Nos. 4,680,799 and 4,937,876, respectively, also disclose hearing aid devices with conventional housings, which occlude the ear canal and comprise a unitary enclosure for microphone, battery and receiver components within.

Weiss et al. in U.S. Pat. Nos. 3,783,201 and 3,865,998 disclose an alternate hearing device configuration which fits partially in the ear canal (FIG. 1 in both Weiss et al patents) with a separate microphone 14 and receiver 18. The main housing, enclosing battery and amplifier, are designed for fitting in the concha area outside the ear canal as shown. The microphone 14 is positioned in the pinna completely outside the ear canal. The device is obviously not completely placed in the ear canal and thus visible.

Geib in U.S. Pat. No. 3,527,901 discloses a hearing device with housing made of soft resilient material, which encloses the entire body of the device. This approach eliminates conventional rigid enclosures thus presumably more comfortable to wear. However, the unitary enclosure does not provide any improvement in space efficiency. Furthermore, the hearing device was clearly not designed to fit entirely in the ear canal, Geib stating that "the hearing aid makes a much better fit within the concha and ear canal of the user thereby providing a more effective seal and reducing the problems of direct acoustic feedback" (col 2, lines 40–43 of Geib).

Hardt in U.S. Pat. No. 4,607,720 discloses a hearing device which is mass-producible with a soft sealing plug that is serially attached to the receiver. Although the invention solves the problem of custom manufacturing, the unitary enclosure (containing major hearing aid components: battery, microphone and receiver) is also space-inefficient for deep canal fittings.

Voroba et al in U.S. Pat. No. 4,870,688 also discloses a mass-producable hearing aid. The device comprises a solid shell core (20 in Voroba's FIGS. 1 and 2) which is covered by a flexible covering 30 affixed to the exterior of the rigid core 20. Similarly, the rigid core represents a unitary enclosure for containing all major hearing aid components, and thus, considered space-inefficient for deep canal fittings.

McCarrel, et al, Martin, R., Geib, et al., and Adelman R., in U.S. Pat. No. 3,061,689, RE26,258, U.S. Pat. Nos. 3,414,685 and 5,390,254, respectively, disclose miniature hearing devices with a receiver portion flexibly separate from a main part. The receiver portion is insertable into the ear canal with the main part occupying the concha (McCarrel's FIG. 2, Geib's FIG. 10, Adelman's FIG. 3B). This placement facilitates access to the device for insertion and removal. The main part in the above devices contains all the major components of a hearing device including the battery, amplifier and microphone, but excluding the receiver. Therefore, the main part is not space-efficient sufficiently to fit the ear past the aperture of the ear canal for most individuals. Furthermore, the cartilaginous part of the ear canal is substantially occluded or not exposed to the outer environment, thus requiring frequent removal of the device from the ear canal.

Shennib et al, in U.S. Pat. No. 5,701,348, disclose an articulated hearing device with flexibly connecting modules. "The main module 12 includes all of the typical components found in hearing devices, except for the receiver (lines 64–66, col 6)." The main module includes a battery 16, a battery compartment 15, circuit 17 (amplifier) and microphone 14. Because if its articulated design and assorted soft acoustic seal 43, the invented hearing device can fit a variety of ear canals without resorting to custom manufacturing, thus can be mass-producible as disclosed. Although a CIC configuration is disclosed (see FIG. 23 in Shennib), the depth of insertion, particularly for small and contoured ear canals, is severely limited by the design of the main module 12 which contains within the power source (battery) along with other major components (e.g., the microphone). Furthermore, the device in any of its disclosed configurations, substantially occludes the ear canal in the cartilaginous region, and thus could interfere with hair and the natural production of physiologic debris. Therefore, the disclosed CIC device of the Shennib is not suitable for extended wear.

It is a principal objective of the present invention to provide a highly space-efficient hearing device, which is completely positioned in the ear canal.

A further objective is to provide a mass-producible design which does not require custom manufacture or individual ear canal impression.

A further objective is to provide a hearing device which does not occlude the cartilaginous part of the ear canal thus minimally interfering with hair and the natural production and extrusion of physiologic debris in the ear canal.

Yet another objective of particular importance is to provide a canal hearing device which is suitable for extended wear, so that it does not require daily removal from the ear canal.

Extended wear as used in this specification and appended claims is defined as continuous placement and use of the hearing device within the ear canal without need for removal for a relatively significant period of time, at least about one week.

SUMMARY OF THE INVENTION

The present invention provides a generic canal hearing device, which is positioned deeply and completely within the ear canal, and is particularly suited for extended wear. The canal device occludes the bony part of the ear canal for sealing within while extending laterally into the cartilaginous part in a non-occluded fashion. The canal device comprises a cylindrically elongated battery assembly having a generally oval cross-sectional perimeter with a sectional void for mating with a universal core assembly. The battery assembly comprises a thin enclosure with an outer surface directly exposed to the environment of the ear canal. The invention is characterized by the lack of a unitary rigid enclosure or rigid main housing, typically enclosing a battery along with other components as in prior art designs.

The battery assembly is removably connected to the universal core assembly. The battery assembly and a microphone section of the core assembly form a lateral section when attached for positioning comfortably in the cartilaginous part of the ear canal past the aperture thereof.

The lateral section is substantially cylindrical with oval cross-sectional perimeter and medial tapering at the bony-junction of the ear canal. The oval cross-sectional perimeter of the lateral section is smaller than that of the ear canal thus makes little or no contact with the walls of the ear canal when inserted therein. The lateral section is therefore positioned in the ear canal in a non-occluding fashion with minimal interference with hair and earwax production. The acoustic occlusion effect is also minimized by directing occlusion sounds away from the eardrum towards the outside of the ear canal.

The core assembly also comprises a receiver section flexibly connected to the microphone section. The receiver section is positioned in the bony part of the ear canal past the bony-junction. The receiver section contains a receiver, which delivers sound towards the eardrum within exceptional proximity for minimizing energy consumption and improving high frequency response. The receiver section is securely anchored in the bony part of the ear canal by a conforming sealing retainer concentrically positioned around (i.e., over) the receiver section. The flexible connection between the receiver section and lateral section facilitates the insertion and removal of the hearing device in the ear canal, particularly through the bony-junction area.

In the preferred embodiments of the invention the battery assembly is generically in available in an assortment of various shapes and sizes for selection of optimal fit and maximum energy capacity according to the individual ear being fitted. The battery assembly in the preferred embodiments is disposable and comprises protruding contacts for insertion into the microphone section thus providing electrical and mechanical connections to the core assembly of the hearing device. In another embodiment of the invention, the core assembly is disposable and incorporates the battery within it.

The hearing device of the invention is mass-producible and accommodates a variety of canal shapes and sizes without resorting to custom manufacturing or canal impressions.

The space and energy efficient design of the invention allows for a comfortable extended use within the ear canal without resorting to daily removal as commonly required by conventional canal devices. In the preferred embodiments, the invented device is remotely switched on/off by a remote control for optionally conserving the battery energy while the device remains in the ear canal during sleep or non-use.

BRIEF DESCRIPTION OF THE DRAWINGS

The above and other objectives, features, aspects and attendant advantages of the invention will become further apparent from a consideration of the following detailed description of the presently contemplated best mode of practicing the invention, with reference to certain preferred embodiments and methods thereof, in conjunction with the accompanying drawings, in which.

DETAILED DESCRIPTION OF THE PREFERRED EMBODIMENTS AND METHODS

Figure 1:
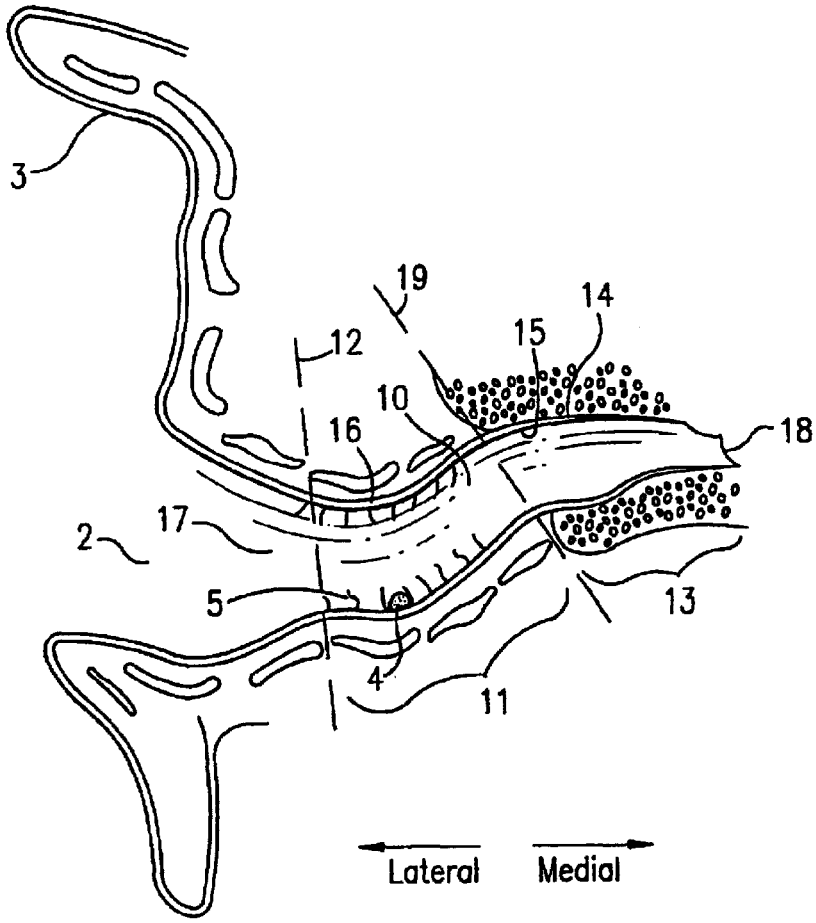
FIG. 1 is a side coronal view of the external ear canal.

The present invention provides a hearing device positioned entirely in the ear canal in a minimally occluding fashion and thus particularly suited for extended use without resorting to daily removal from the ear canal. For the sake of additional clarity and understanding in the ensuing description, the disclosures of the aforementioned related co-pending '741 patent and '699 application (see section titled "Cross-Reference to Related Applications", above) are incorporated herein by reference.

The canal hearing device 1 of the present invention, shown in FIGS. 5–16, comprises a core assembly 45 (FIG. 7) having a microphone section 60 adapted to be substantially positioned laterally in the cartilaginous region 11 and a receiver section 70 adapted to be substantially positioned medially in the bony region 13 of the ear canal. The device also comprises a battery assembly 50 removably connected to microphone section 60. The battery assembly 50 and microphone section 60 form a lateral section 40 when combined. When the hearing device 1 is inserted into position within the ear canal 10, the lateral section 40 is essentially suspended in the cartilaginous region 11 in a non-occluding fashion with only incidental contact (i.e., minimum or no contact) with the walls of the canal thereof.

With such positioning of the hearing device, the receiver section 70 is secured to the bony part of the ear canal via a conforming sealing retainer 80, which is concentrically positioned around or over the receiver section 70. The sealing retainer 80 acoustically seals the canal at the bony region for preventing acoustic feedback while securing the core assembly 45 and the attached battery assembly 50. The sealing retainer 80 comfortably conforms to the walls of the ear canal in the bony region, where it is to be seated, for ease of insertion and retention of the hearing device 10 within the canal.

The receiver section 70 is flexibly connected to the microphone section 60 via a flexible connection 79, which also provides electrical connectivity therebetween. The flexible connection 79 facilitates insertion of the device 1 by bending when being inserted through the contours of the ear canal, particularly through the second bend at the bony-junction 19. The receiver section 70 contains a receiver 71 (transducer) with a receiver sound port 75 for emitting sounds 9 (FIG. 5) towards the tympanic membrane 18, with which it is in close proximity.

Figure 2:
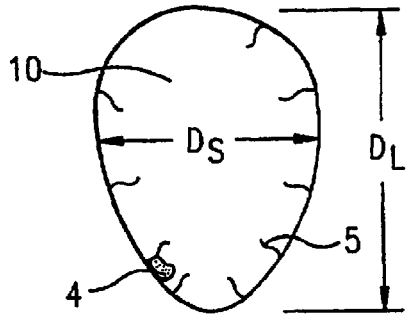
FIG. 2 is a cross-sectional view of the ear canal in the cartilaginous region.
Figure 3:
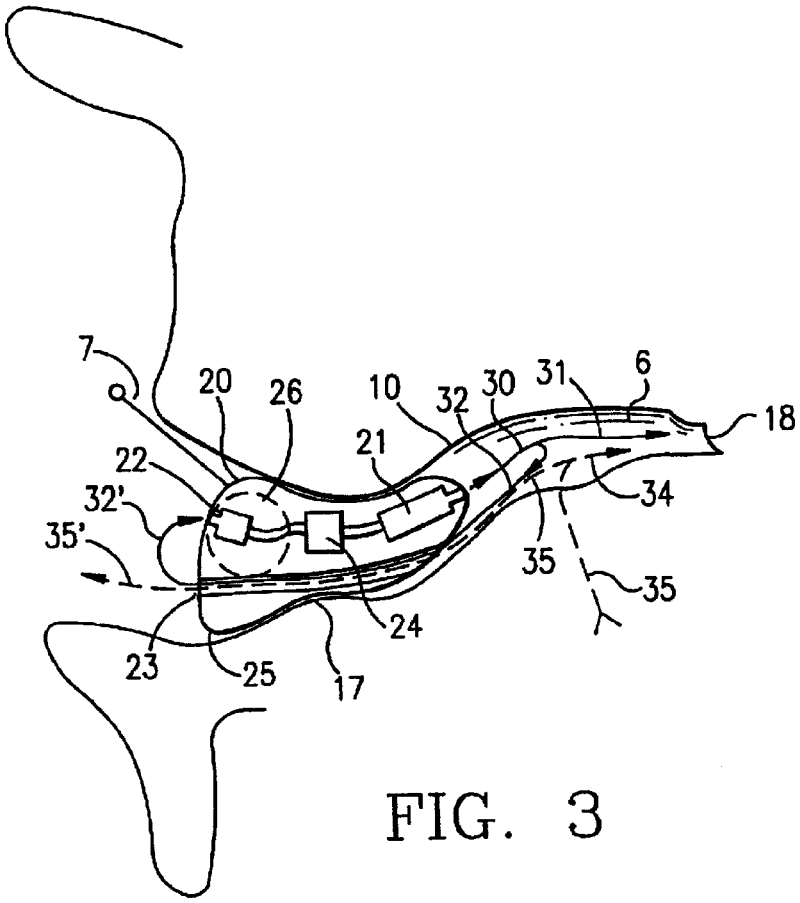
FIG. 3 is a side view of the ear canal occluded by a conventional canal hearing aid.
Figure 4:
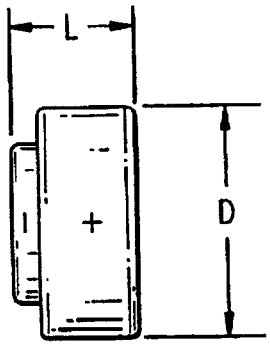
FIG. 4 is a view of a typical button-cell battery showing the diameter (D) and length (L) dimensions.
Figure 5:
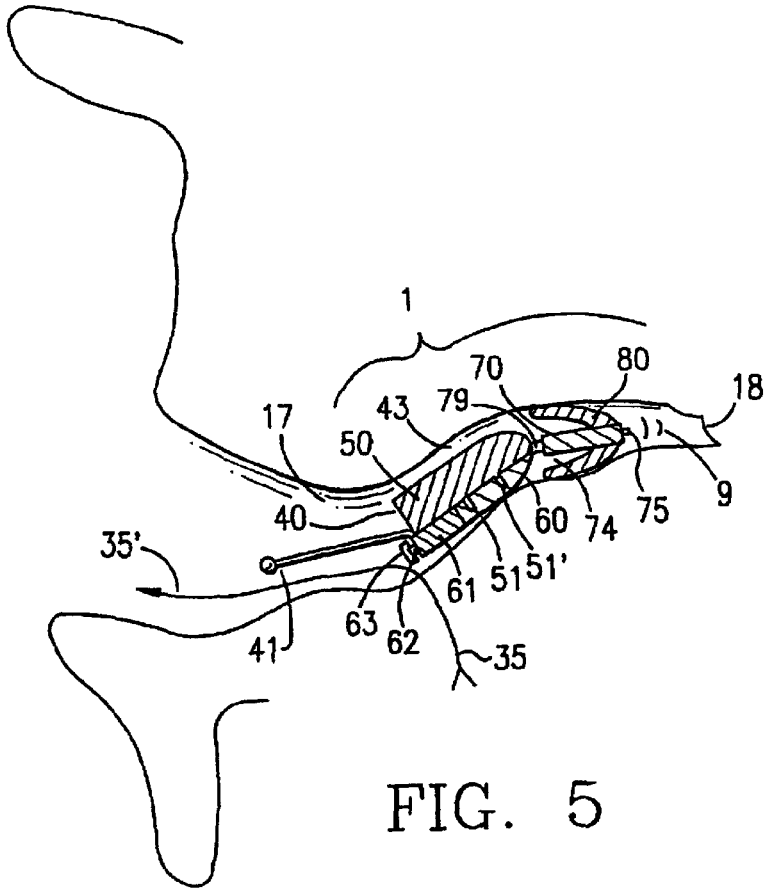
FIG. 5 is a side view of the ear canal with a preferred embodiment of the canal hearing device of the present invention completely inserted within it, the device having a non-occluding lateral section at the cartilaginous part of the ear canal, and a receiver section occluding the bony part of the canal via a conforming sealing retainer.
Figure 7:
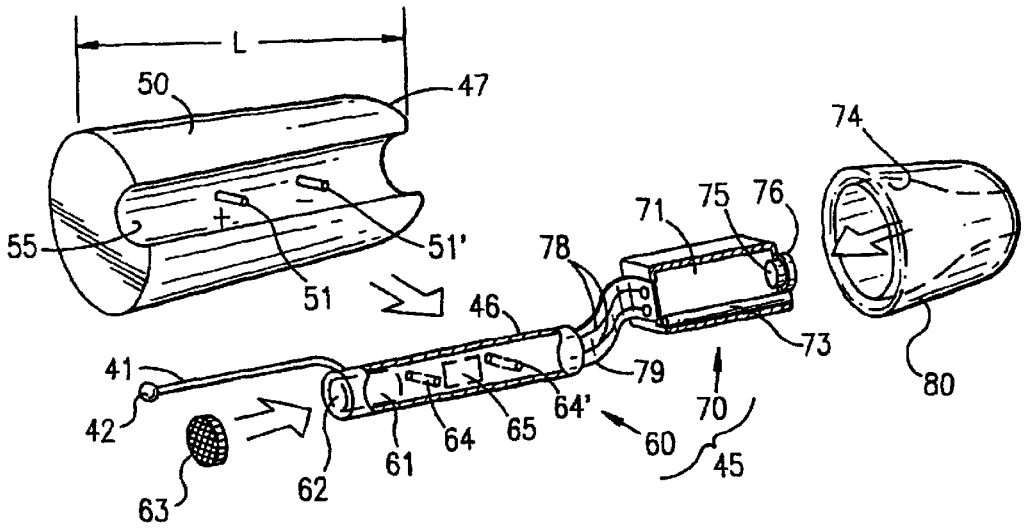
FIG. 7 is an exploded view of the canal device embodiment of FIGS. 5 and 6 with core assembly, battery assembly and sealing retainer disassembled.
Figure 8:
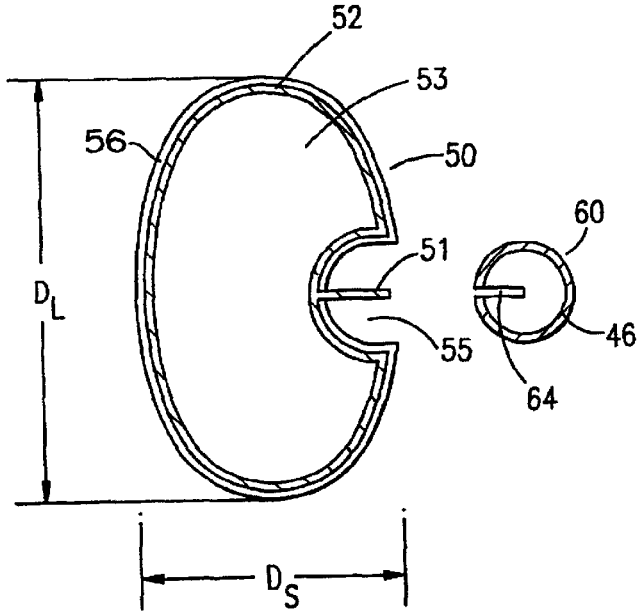
FIG. 8 is a cross sectional view of the lateral section of this embodiment, with battery assembly having a pin connector unattached to the microphone section having a receptacle.

The battery assembly 50 of the present invention has a generally oval cross sectional perimeter as shown in FIG. 8. The oval perimeter has long diameter $D_L$ and short diameter $D_S$, corresponding to the long and short diameters, respectively, of the typical ear canal 10 shown in FIG. 2. The battery assembly 50 is generally cylindrically elongated (L in FIG. 7) along the longitudinal axis of the hearing device 1, which corresponds to the longitudinal axis of the ear canal when the device is inserted into position in the canal, as shown in FIG. 5. The length L is greater than the long diameter $D_L$ of the oval cross-section in the preferred embodiments. The cylindrically elongated shape of the present battery assembly represents a drastic departure from conventional button-cell hearing aid batteries. Another contrast of the battery assembly of the present invention is that conventional batteries are designed for placement within a separate battery compartment and within a unitary plastic housing, thus do not make direct contact with the environment of the ear canal. In contrast, the battery assembly 50 of the present invention comprises its own thin biocompatible enclosure 56, which may be disposed of along with the battery 52 (FIGS. 8–11) when the battery power is depleted, within the battery assembly 50.

Figure 9:
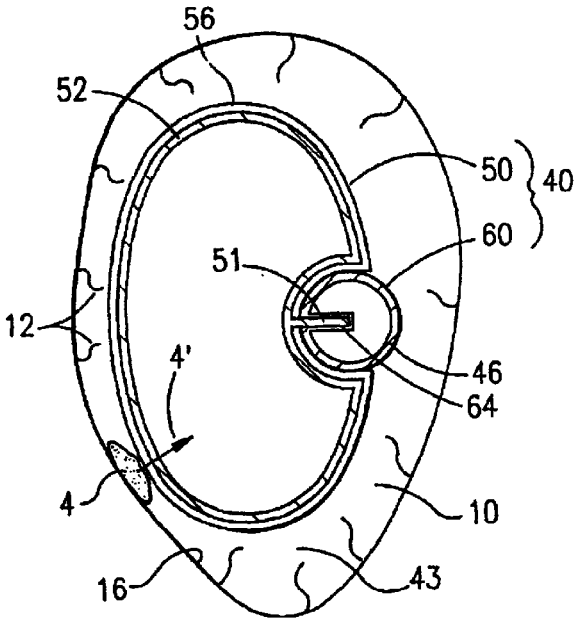
FIG. 9 is a cross-sectional view of the lateral section inserted into the ear canal, showing the substantial air-space clearance and minimal contact with the walls of the ear canal.
Figure 10:
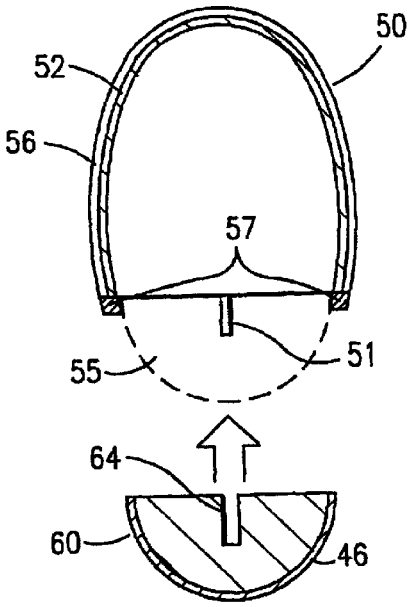
FIG. 10 is a cross-sectional view of an alternate embodiment of the lateral section, in which the battery assembly has a flat-top insertable into a receptacle within the microphone section for mating therewith via a pin connector.
Figure 11:
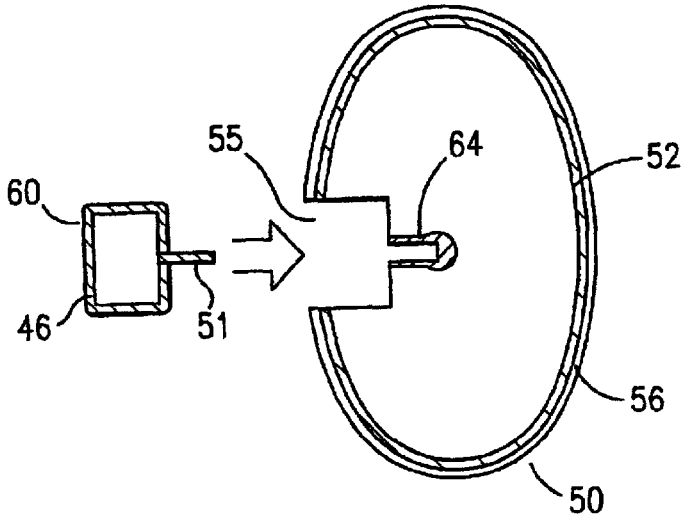
FIG. 11 is a cross-sectional view of another alternate embodiment of the lateral section, in which the battery assembly has a rectangular sectional void in its side, and the microphone section includes a pin connector insertable into a receptacle within the battery assembly.

The battery assembly 50 of a preferred embodiment of the present invention comprises a battery 52 within enclosure 56, having a sectional void 55 (FIGS. 7 and 8) for accommodating (receiving) microphone section 60. When the battery assembly and the microphone section are so combined by being mated together, the resultant lateral section 40 has a shape which is primarily that of the removable battery assembly, and is thus also cylindrically elongated and of generally oval cross-sectional perimeter as shown in FIG. 9. The removable attachment of the battery assembly 50 to the microphone section 60 of the core assembly 45 is preferably through one or more protruding electrical contacts (e.g., connector pins) as shown in FIGS. 6–11. For example, FIGS. 5–8 show positive connector pin 51 and negative connector pin 51' insertable in microphone section 60 via pin receptacle 64 and 64' (FIGS. 7 and 8), respectively. FIG. 11 shows connector pin 51 alternatively positioned on the microphone section 60 while pin receptacle 64 is positioned on the battery assembly 50. Insertable pin connection is a preferred method for providing reliable and space-efficient electrical and mechanical connectivity between the battery assembly 50 and the core assembly 45.

The sectional void (recess) 55 may be of any appropriate shape to accommodate the battery section 60 of the core assembly 45. For example, FIGS. 8 and 9 show a side semi-circular sectional void to accommodate a circular microphone section. FIG. 10 shows a flat-top semi-circular void for mating on top of a semi-circular microphone section 60. FIG. 11 shows a rectangular sectional void 55 for accommodating a microphone section 60 having a rectangular cross-section. Regardless of the mating configuration between the battery assembly and the microphone section, the outer surface of the formed lateral section 40 is primarily that of the battery section comprising at least 60% of the combined surface area. A sealant or a gasket, composed of an appropriate sealing material, is preferably provided at interface area between the battery assembly 50 and the microphone section 60 for protecting the electrical contacts therebetween. FIG. 10 shows a sealing gasket 57 incorporated onto the battery assembly 50.

The microphone section 60 comprises a microphone 61 (transducer) having a sound port 62 (FIGS. 5 and 7) for receiving unamplified sounds entering the ear canal 10. The microphone section 60 may also comprise signal processing amplifier 65 (FIG. 7) and other components (not shown in FIG. 7) commonly used in hearing aids. Microphone port 62 is protected by a debris guard 63 which is made by an acoustically transparent and moisture-proof material. The debris guard 63 protects the sensitive diaphragm (not shown) within the microphone 63 from the damaging effects of moisture, cerumen and other debris entering the ear canal. The receiver sound port 75 (FIG. 7) may also be protected by a receiver debris guard 76. Debris accumulation eventually renders debris guards ineffective. Therefore, in the preferred embodiments of the invention, the debris guards, 63 and 76, are replaceable for periodic disposal thereof as necessary.

FIG. 9 shows a cross-sectional view of the ear canal with lateral section 40 positioned in the cartilaginous region 11 in a substantially non-occluding fashion. As illustrated, a substantial clearance 43 (air-space) exists between the perimeter of the lateral section 40 and the interior walls 16 of the ear canal in this region. This minimizes interference with hair 12 and cerumen (earwax) 4 production present in the cartilaginous part of the ear canal 10 as shown. Since the lateral section 40 is flexibly connected to the relatively immobile receiver section 70 in the bony part via flexible connection 79, the lateral section is allowed to move within the ear canal in response to canal deformations during jaw movements, or in response to cerumen accumulation. FIG. 9 shows, for example, cerumen 4 between the lateral section 40 and a wall 16 of the ear canal. Cerumen accumulation pushes the movable lateral section 40 in the direction of arrow 4' as shown. The clearance 43 also minimizes the acoustic occlusion effect by diverting occlusion sounds (35 and 35' in FIG. 5) away from the tympanic membrane 18 (protected by the sealing retainer 80) towards the outside of the ear canal.

The minimal contact of the non-occluding lateral section 40 also allows for natural production and lateral migration of cerumen and other debris in the cartilaginous region 11. The receiver section 70, in contrast, occludes the ear canal in the bony region 13 via the associated sealing retainer 80 as shown in FIG. 5.

The core assembly 45 and battery assembly 50 each have individual thin encapsulation 46 (FIGS. 7–11) and 56 (FIGS. 8–11), respectively. The encapsulation preferably comprises a moisture-proof material or coating such as silicone, parylene or acrylic. The thin encapsulation may be made soft such as soft silicone or rigid such as hard acrylic. Obviously, the enclosure at the flexible connector 79 must be made of flexible material. The microphone section 60 may comprise a rigid substrate, or potting, protective of internal components within. Since the hearing device of the invention is handled relatively infrequently owing to its extended wear capability, the thickness of any encapsulation can be safely substantially thinner than conventional enclosures of CIC devices, which are typically in the range of 0.5–0.7 mm. The core assembly encapsulation 46 and battery encapsulation 56 are preferably less than 0.3 mm. in thickness, and even much thinner for the battery assembly since it is removable and disposable in the preferred embodiments. The thin battery encapsulation 56 substantially conforms to the shape of the battery, thus adding negligible dimensions to the enclosed battery.

Figure 12:
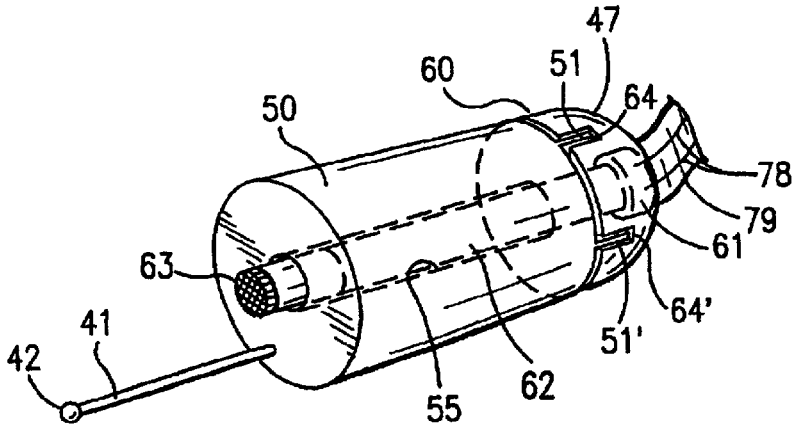
FIG. 12 is a view of still another alternate embodiment of the lateral section in which the battery assembly has a sectional void at its center for insertion of the microphone port.

FIG. 12 shows an alternate embodiment of the cylindrically elongated battery assembly 50 having a sectional void 55 completely within the battery assembly 50 for accommodating the microphone sound port 62. In this alternate configuration, the microphone section 60, comprising a microphone 61 within, is medially positioned to the battery assembly having the microphone sound port 62 extending through the central cavity formed by the sectional void 55. A cylindrical microphone 61, such as model FG3329 manufactured by Knowles Electronics of Itasca, Ill., may also be partially or fully inserted in the sectional void 55 of FIG. 12. The battery assembly 50 of the configuration in FIG. 12 is removably connected to microphone section 60 via pin connectors 51 and 51', which are inserted in receptacles 64 and 64', respectively, within microphone section 60. Alternatively, a non-insertable conductive contact between the battery assembly 50 and microphone section 60 may be employed. However, in the preferred embodiments of the invention, at least one insertable connector pin is preferably provided for a secure space-efficient mechanical connectivity in addition to electrical connectivity between the removable battery assembly 50 and the microphone section 60 of the core assembly 45. Removable debris guard 63 (FIG. 12) protects the microphone sound port 62 until becoming too soiled and ready for replacement.

FIGS. 5–7 and 12 also show flexible connector 79, flexibly connecting lateral section 40 with receiver section 70. Flexible connector comprises conductive electrical wires 78 (FIGS. 6 and 7) for conducting power and amplified electrical signals from the microphone section 60 to the receiver 71 within receiver section 70. The flexible connection may comprise a flexible wire cable, flexible circuit, or other flexible conductive means known in the art of miniature electromechanical design.

Figure 6:
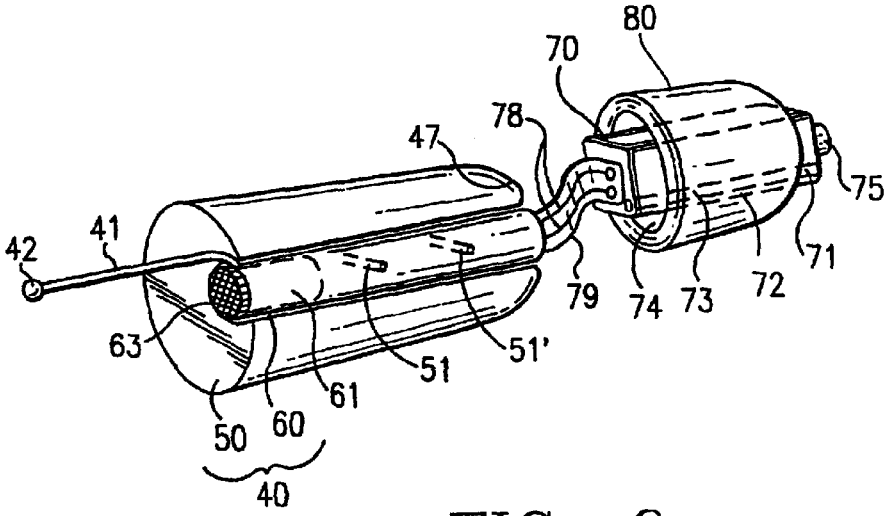
FIG. 6 is a detailed view of the non-occluding canal device embodiment of FIG. 5, showing a lateral section, including cylindrically elongated battery assembly and microphone section, which is flexibly connected to the receiver section with sealing retainer concentrically positioned around (i.e., over) it.

FIGS. 5–7 shows a captive strand 41 with knob 42 incorporated into the microphone section, to assist in the insertion and removal of the hearing device into or from the ear canal. FIG. 12 incorporates the strand 41, alternatively, into the battery assembly. The strand can be used by either the individual wearing the device or by the professional dispenser (e.g., hearing aid dispenser, audiologist, otolaryngologist, etc) for placement and removal.

Figure 13:
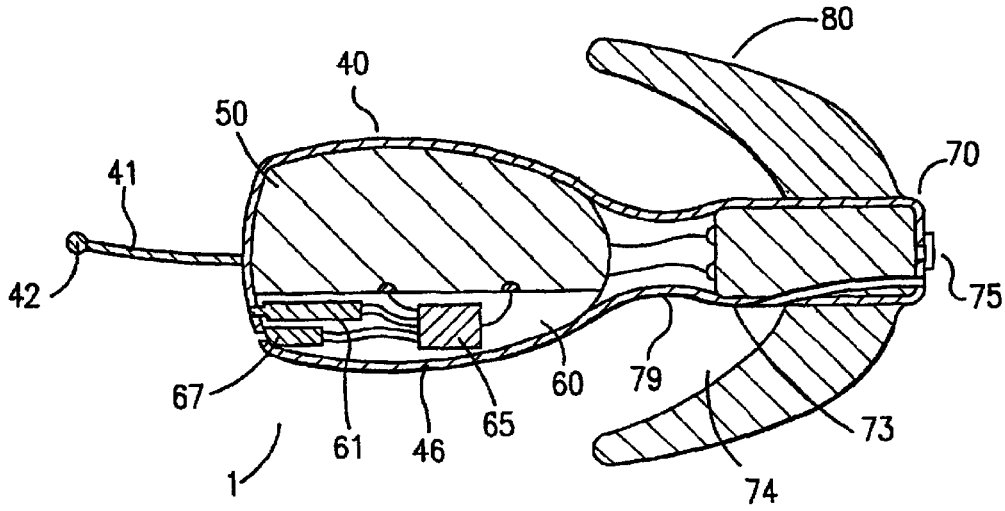
FIG. 13 is a view of a disposable device embodiment of the invention, in which the battery is also incorporated within the lateral section of the core assembly.

FIG. 13 shows a side view of an alternate embodiment of the present invention for a single-use disposable hearing device 1, (i.e., the device may be discarded when the battery power becomes depleted) having battery assembly 50 incorporated (non-removable) within lateral section 40. The battery assembly 50 is also cylindrically elongated and having oval cross-sectional perimeter with sectional void to accommodate a microphone section 60 forming a lateral section 40 also cylindrically elongated and oval in cross-section. Similar to the previously disclosed embodiment, the lateral section 40 optimally fits in a non-occluding manner in the cartilaginous part 11 of the ear canal. The receiver section 70 is fitted in an occluding sealing manner in the bony part 13 of the ear canal via the sealing retainer 80 concentrically positioned around or over the receiver section.

FIGS. 6, 7 and 13 also show a receiver section 70 with vent 73 across the long axis for pressure equalization during insertion and removal of the canal device or during changes in atmospheric pressures while the hearing device 1 is worn in the ear canal. The pressure vent 73 is very small typically having a diameter less than 0.5 mm, thus does not easily allow water to pass through, even during swimming. The receiver section 70 is also encapsulated with thin encapsulation material similar to the microphone section 60.

Figure 14:
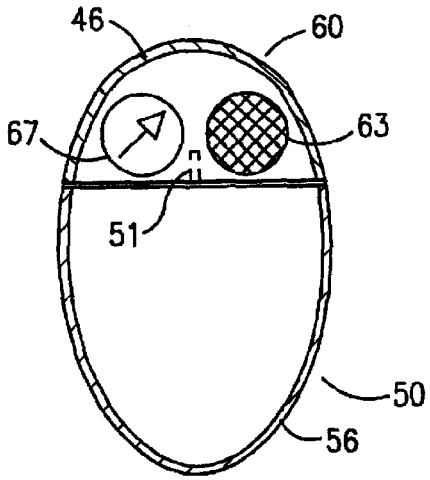
FIG. 14 is a cross sectional view of the lateral section of FIG. 13, showing an embodiment in which the microphone section resides atop a removable battery assembly.
Figure 15:
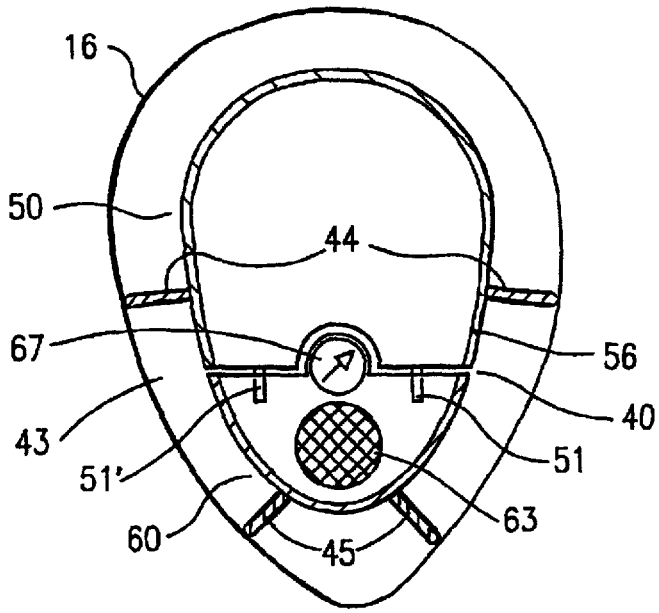
FIG. 15 is a cross sectional view of the lateral section of FIG. 13, showing an alternate embodiment in which the microphone section resides below a removable battery assembly when inserted in the ear canal, and with a non-occluding stabilizer.

In a preferred embodiment, the microphone section 60 comprises microphone 61, control element 67 (e.g., volume trimmer as shown in FIGS. 13–15) and switch assembly 66 (FIG. 16) for remotely turning the device off during sleep or non-use. The switch assembly 66 may consist of a latchable reed-switch, which is remotely activated by a control magnet (not shown). The microphone 61 may have a signal processing amplifier integral within it (for example, series FI-33xx manufactured by Knoweles Electronics of Itasca, Ill.) This integration reduces the size of the microphone section, which further reduces occlusion effects within the ear canal at the cartilaginous region. Alternatively, a signal processing amplifier 65 may be a separate component as shown in the embodiment of FIGS. 7, 13 and 16.

FIGS. 14 and 15 show opposite arrangements of the microphone assembly with respect to the battery assembly 50. FIG. 14 shows a top placement of the microphone assembly 60 while FIG. 15 shows a bottom placement thereof. Control element 67 is provided medially to facilitate in-situ (while device worn in the canal) access for adjustment. FIG. 15 also shows a non-occluding stabilizer, having lower section 45 and side section 44, to aid in centering and stabilizing the lateral section 40 within the ear canal (otherwise flopping within during motions). A stabilizer also ensures substantial clearance 43 between the surface of the lateral section 40 and the walls 16 of the ear canal at the cartilaginous part thereof. The non-occluding stabilizer must be suitably made of soft and biocompatible material such as silicone. The non-occluding stabilizer can be designed in other arrangements as will become obvious to those skilled in the art.

The medial end 47 (FIGS. 5–7, 12, 13 and 16) of lateral section 40 of the invented canal device is preferably tapered as shown to facilitate comfortable insertion of the canal device within the contoured ear canal. The shape of the medially tapered cylindrically elongated lateral section 40 resembles a bullet.

Figure 16:
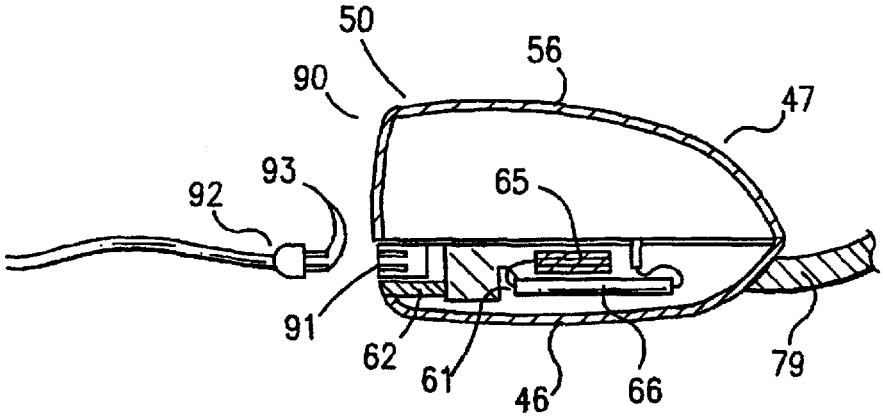
FIG. 16 is a side view of an embodiment of a programmable canal device of the invention illustrating a programming receptacle for receiving programming signals from a programming connector.

The hearing device of the present invention can be made in a programmable configuration as shown in FIG. 16. The programmable hearing device 90 has programming receptacle 91 for receiving programming signals from a programming connector 92. The programming connector comprises programming pins 93, which are temporarily inserted into programming receptacle 91 during the programming of the hearing device 90. Programmability allows the hearing device 90 to be electronically adjusted via an external programming device (not shown). Other means for remotely programming or adjusting a hearing device are well known in the field of hearing aids and include the use of sound, ultrasound, radio-frequency (RF), infra-red (IR) and electromagnetic (EM) signals.

Figure 17:
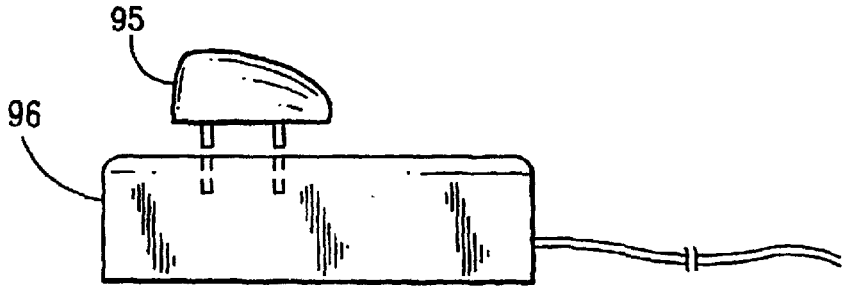
FIG. 17 is a view of a rechargeable battery assembly adapted for insertion into a battery charging unit.

The removable battery assembly 50 may comprise a primary battery (disposable) or a rechargeable battery therein. A rechargeable battery assembly 95 (FIG. 17) may be recharged by an external charger unit 96 or by other in-situ charging methods, including remote charging commonly employed in rechargeable implant devices.

In the disposable battery embodiments of the present invention, the battery assembly 50 is preferably provided in generic assortment to fit a variety of ear canal sizes and shapes. This is accomplished by providing a universal core assembly 45 which is combined with one of the generically assorted battery assemblies according to the individual ear being fitted in order to optimize the non-occluding fit and the energy capacity (battery size) without resorting to any custom manufacturing.

The moisture-proofing, provided by the thin encapsulation (or potting) and the debris guards, allow the hearing device to safely withstand humidity and wet environments (e.g., shower, swimming, rain, etc.). Since the outer surface of lateral section and the walls of the ear canal are substantially exposed to air outside the ear canal, drying of water introduced into the ear canal is expected after the person returns to a normal dry environment. This prevents accumulation of moisture within the ear canal. The pressure vent 73 associated with receiver section 70 is too small, by design, to allow water passage through it, even during swimming.

The ratio of the long ($D_L$) to short ($D_S$) diameters of the oval lateral section 40 is preferably approximately 1.4 according to the experiment (see below) conducted by the inventors.

The sealing retainer 80 fills the gap between receiver section 70 and the walls 14 of the ear canal in the bony part, for seating therein. However, for improved comfort and ease of fit, the lateral part of the sealing retainer is flanged with an air-gap 74 forming laterally between the sealing retainer 80 and the receiver section 70 as shown in FIGS. 5–7 and 13. This air-gap 74 allows the sealing retainer to better conform to the individual shape of the ear canal thus becoming generic without resorting to custom manufacturing. The sealing retainer 80 comprises a soft compressible and conforming material such as polyurethane foam or like material (a polymer), or silicone or like material. The sealing retainer 80 must provide significant acoustic attenuation in order to seal and prevent feedback. In the preferred embodiments, the sealing retainer 80 does not comprise any rigid core material (other than the receiver section inserted within) in order to maximize the fit and comfort within the bony region of the ear canal. The sealing retainer is preferably oval with long diameter $D_L$ approximately 1.5 times that of the short diameter $D_S$.

Figure 18:
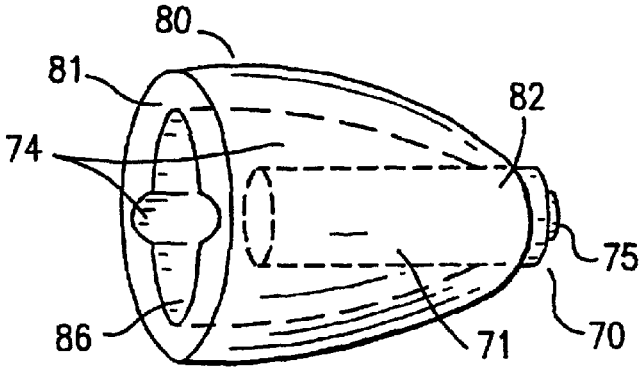
FIG. 18 is a perspective side view of the sealing retainer of a preferred embodiment showing the air-gap (cavities) between the sealing retainer and the receiver section (indicated by a dashed perimeter) within it.
Figure 19:
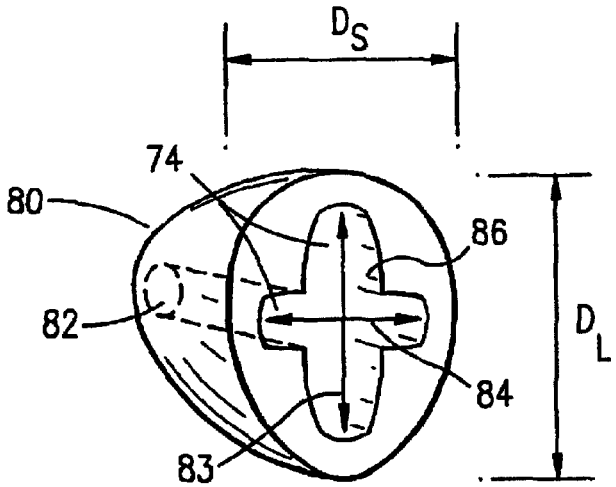
FIG. 19 is a perspective view of the sealing retainer of FIG. 18, taken from the lateral end, also showing the air-gap.

In a preferred embodiment shown in FIGS. 18 and 19, the inferior (lower) portion of the sealing retainer is relatively pointed to match the shape of typical ear canals in the bony region. The sealing retainer 80 is substantially hollow with an air-gap 74 between the body 81 of sealing retainer 80 and the receiver section 70 inserted therein (as illustrated by the dashed perimeter). The medial opening 82 of the sealing retainer 80 is stretchable and is made smaller than the diameter of the receiver section 70 in order to provide a tight fit for sealing and securing the receiver section 70 and the associated hearing device 1 within the ear canal. The air-gap 74 is made by vertical 83 and horizontal 84 cavities, in the shape of a cross, extend medially from the lateral end 86 of the sealing retainer 80. These cavities, forming the internal air-gap, increase the compressibility and conformity of the sealing retainer, thus can be worn more comfortably in the bony region 13 which is known for being extremely sensitive to pressure. Furthermore, cavities, 84 and 76, may be laterally extended to allow for partial enclosure of the flexible connector 79 and even part of the lateral section 40 as shown in FIG. 13. In the preferred embodiments of the invention the receiver section 70 extends medially past the sealing retainer 80 as shown in the FIGS. 6 and 18.

The sealing retainer 80, made of polyurethane foam, silicone or like material as described above, is compressible and retardedly expandable with time thus allowing for a temporary compression state prior to and during insertion into the ear canal, with subsequent expansion to a fully conforming and sealing state.

The seals may incorporate a lubricant material (not shown), particularly along the contact surface, to further facilitate insertion and removal within the ear canal. The seals may also be treated with medication material to minimize possible contamination and infections within the ear canal. The medication may include anti-bacterial, anti-microbial and like agents, for example.

In a preferred embodiment of the sealing retainer of the invention, the sealing retainer 80 was made into an assortment of 4 sizes (small, medium, large and extra-large) to accommodate the broadest range of ear canals. The dimensions of a fabricated assortment are tabulated in Table 1 below. The dimensions were partially derived from measurements of actual ear canal dimensions obtained from cadaver impressions as explained below in the section titled Experiment. The sealing retainer 80 may be assorted in other sizes and shapes as may be required by once a larger population of ears is studied.

TABLE 1

| Size | Short Diameter ($D_S$) in mm | Large Diameter ($D_L$) in mm |
|---|---|---|
| Small | 4.5 | 7.25 |
| Medium | 5.75 | 9.35 |
| Large | 7.3 | 12 |
| Ex-Large | 9.0 | 15 |

The sealing retainer is preferably disposable and must be biocompatible and hypoallergenic for a safe prolonged wear in the ear canal. The sealing retainer may also incorporate a vent (not shown) for pressure equalization.

Certain individuals may have difficulty wearing the sealing retainer due to sensitivity of their ear canal, medical condition, or other concerns. Therefore, the sealing retainer may be separately inserted, without the core assembly, for a period of time sufficient to assess comfort and appropriateness of wear prior to inserting the entire hearing device. This may represent a "trial wear" for an individual who may be reluctant to wear or purchase the device for whatever reason.

The canal hearing devices of the above embodiments are suitable for use by hearing impaired individuals. However, the unique characteristics of such devices are equally applicable for audio and other communication applications. Furthermore, the hearing device may be wirelessly connected to an external audio device via the appropriate wireless communication method (not shown).

Experiment

Figure 20:
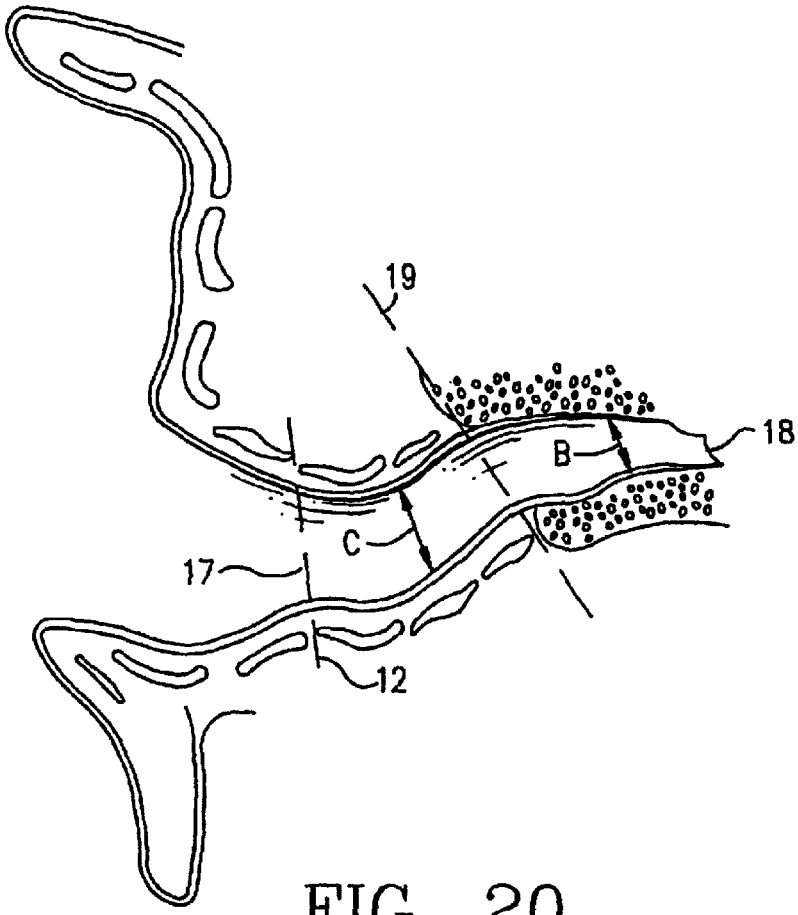
FIG. 20 is a side view of the ear canal showing central locations of the cartilaginous region (C) and the bony region (B) for measurements of canal diameters at those locations.

In a study performed by the applicants herein, the cross-sectional dimensions of ear canals were measured from 10 canal impressions obtained from adult cadaver ears. The long (vertical) and short (horizontal) diameters, $D_L$ and $D_S$ respectively, of cross sections at the center of the cartilaginous region (C in FIG. 20) and the bony region (B) were measured and tabulated (Table 2, below). The diameters where measured across the widest points of each cadaver impression at each region. All measurments were taken by a digital caliper (model CD-6"CS manufactured by Mitutoyo). The impression material used was low viscosity Hydrophilic Vinyl Polysiloxane (manufactured by Densply/Caulk) using a dispensing system (model Quixx manufactured by Caulk).

TABLE 2

| | C-Region Diameters in mm | | | B-Region Diameters in mm | | |
|---|---|---|---|---|---|---|
| Sample # | Short ($D_S$) | Long ($D_L$) | Ratio($D_L/D_S$) | Short ($D_S$) | Long ($D_L$) | Ratio($D_L/D_S$) |
| 1-R | 7.8 | 10.3 | 1.3 | 8.0 | 10.5 | 1.3 |
| 1-L | 7.8 | 11.9 | 1.5 | 8.1 | 11.2 | 1.4 |
| 2-R | 3.8 | 8.9 | 2.3 | 4.2 | 8.9 | 2.1 |
| 2-L | 5.3 | 8.1 | 1.5 | 4.3 | 8.6 | 2 |
| 3-R | 5.5 | 6.3 | 1.2 | 5.0 | 7.7 | 1.5 |
| 3-L | 4.9 | 6.5 | 1.3 | 4.9 | 7.3 | 1.5 |
| 4-R | 6.9 | 9.2 | 1.3 | 6.7 | 10.4 | 1.6 |
| 5-R | 6.9 | 9.2 | 1.3 | 7.5 | 9.5 | 1.3 |
| 5-L | 6.8 | 8.2 | 1.2 | 7.5 | 8.7 | 1.2 |
| 7-L | 6.3 | 7.0 | 1.1 | 4.9 | 6.7 | 1.4 |
| Average | 6.2 | 8.6 | 1.4 | 6.1 | 9.0 | 1.5 |

Results & Conclusion

The diameter dimensions of the ear canal vary significantly among adult individuals. In general, variations occur more so across the short (horizontal) diameters. Furthermore, the ear canal is somewhat narrower (higher long/short ratio) in the bony region than in the cartilaginous region.

Although presently contemplated best modes of practicing the invention have been described herein, it will be recognized by those skilled in the art to which the invention pertains from a consideration of the foregoing description of presently preferred and alternate embodiments and methods of fabrication thereof, that variations and modifications of these exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A single use disposable hearing device adapted for continuous extended wear entirely within an ear canal, comprising:

a core assembly including a lateral section having a microphone and an incorporated, non-removable battery assembly, and a receiver section having a receiver; and a sealing retainer concentrically positioned over said receiver section for conforming to the walls substantially at the bony region of the ear canal, for seating the hearing device in the ear canal and for acoustical sealing against feedback within the ear canal;

said lateral section being of generally oval cross-sectional perimeter with a long diameter $D_L$ and a short diameter $D_S$ and of generally cylindrical and elongated shape along its longitudinal axis, said lateral section being adapted for at least partial lateral suspension in the ear canal without occlusion thereof when said hearing device is seated in the ear canal for allowing said hearing device to comfortable fit in the ear canal and operate continuously therein without daily removal, for an extended period of at least one week.

2. The hearing device of claim 1, wherein said lateral section is medially tapered.

3. The hearing device of claim 1, wherein said lateral section further comprises a stabilizer for positioning between the outer surface of said lateral section and the walls of the ear canal to center and stabilize said lateral section within the ear canal when said device is inserted therein.

4. The hearing device of claim 1, wherein said core assembly comprises a thin moisture-proof encapsulation with its outer surface at least partially exposed directly to the environment of the ear canal when said device is inserted therein.

5. The hearing device of claim 1, wherein said receiver section is flexibly connected to said lateral section to facilitate insertion of said core assembly within the ear canal, and to allow movement of said lateral section in response to canal movements or to accumulation of debris within the ear canal.

6. The hearing device of claim 1, further comprising at least one acoustically-transparent moisture-proof debris guard for protecting a sound port of at least one of said microphone and said receiver.

7. The hearing device of claim 1, further comprising an air vent for pressure equalization.

8. The hearing device of claim 1, wherein said microphone includes an amplifier integral therewith for processing acoustic signal.

9. The hearing device of claim 1, further including programming means for selectively adjusting electroacoustic parameters of said hearing device.

10. The hearing device of claim 1, further including remote control means for controlling at least one control parameter of said hearing device.

11. The hearing device of claim 1, wherein said sealing retainer has an oval cross-sectional perimeter.

12. The hearing device of claim 1, wherein said sealing retainer is composed of compressible material.

13. The hearing device of claim 1, wherein said sealing retainer is composed of conforming material.

14. The hearing device of claim 13, wherein said sealing retainer is composed of silicone or polyurethane foam.

15. The hearing device of claim 1, wherein said sealing retainer is configured to form an air-gap relative to said receiver section when fitted thereon.

16. The hearing device of claim 1, wherein said sealing retainer further comprises medication material selected from a group including anti-bacterial and anti-microbial agents.

17. The hearing device of claim 1, including an assortment of different sizes and shapes of said sealing retainer for assembly of a selected sealing retainer of said assortment with said hearing device to optimally accommodate the dimensions of an individual ear canal.

18. The hearing device of claim 1, wherein said oval cross-sectional perimeter of said lateral section has a long diameter $D_L$ to short diameter $D_S$ ratio of approximately 1.4.

19. A single-use disposable hearing device adapted to be positioned entirely within an ear canal for continuous extended wear therein, comprising:

a core assembly including:

a lateral section containing a microphone and a battery assembly, said battery assembly being non-removably integrated within said lateral section, said lateral section having a generally oval cross-sectional perimeter with long and short diameters, and a receiver section containing a receiver, said receiver section coupled to said lateral section and adapted to be medially positioned in a bony region of the ear canal when said hearing device is inserted within the ear canal; and a sealing retainer concentrically positioned over said receiver section and conforming to the walls of the ear canal at the bony region thereof, for seating said hearing device in the ear canal and providing an acoustic seal to inhibit feedback therein, and for at least partially laterally suspending said lateral section in the ear canal;

said lateral section being dimensioned to be substantially non-occluding with minimal or no contact with the walls of the ear canal when said hearing device is inserted therein for allowing said hearing device to fit comfortably and operate continuously therein without daily removal for an extended period exceeding one week.

20. The single-use disposable hearing device of claim 19, wherein said coupling of the receiver section to the lateral section is a flexible connection.

21. The single-use disposable hearing device of claim 19, wherein said sealing retainer is composed of conforming material.

22. The single-use disposable hearing device of claim 19, wherein said sealing retainer has an air-gap therein.

23. The single-use disposable hearing device of claim 19, wherein said sealing retainer further comprises medication material selected from a group including anti-bacterial and anti-microbial agents.

24. The single-use disposable hearing device of claim 19, including an assortment of different sizes and shapes of said sealing retainer, for assembly of a sealing retainer of selected size and shape among said assortment with the core assembly, to optimally accommodate dimensions of an individual ear canal.

25. The single-use disposable hearing device of claim 21, wherein said sealing retainer comprises polyurethane foam or silicone.

26. A generic single-use disposable hearing device adapted to be positioned entirely within an ear canal for continuous extended wear therein, comprising:

a core assembly with a lateral section of generally oval cross-section and generally elongated cylindrical shape for alignment substantially along an ear canal's longitudinal axis, and with a receiver section having a receiver coupled to said lateral section for medial positioning in an ear canal's bony region; said lateral section being dimensioned to avoid occluding the ear canal while at least partially laterally suspended therein, with a microphone and a battery assembly incorporated in said lateral section; said battery assembly being non-removable such that the device is to be discarded when the battery power is depleted, and a sealing retainer concentrically positioned over said receiver section, of a composition to conform to a wall of the ear canal's bony region wall to seat said hearing device and acoustically seal it in the ear canal to inhibit feedback therein;

wherein said hearing device minimally occludes the ear canal laterally, thereby allowing for comfortable continuous extended wear, including during periods of sleep and shower, for a period approaching depletion of said battery power without resorting to daily removal of the hearing device.

* * * * *